US008633410B2

(12) United States Patent
Yamasaki et al.

(10) Patent No.: US 8,633,410 B2
(45) Date of Patent: Jan. 21, 2014

(54) SWITCH

(75) Inventors: Masanobu Yamasaki, Shiga-ken (JP); Yasuhide Matsuoka, Shiga-ken (JP)

(73) Assignee: Panasonic Corporation, Osaka (JP)

( * ) Notice: Subject to any disclaimer, the term of this patent is extended or adjusted under 35 U.S.C. 154(b) by 170 days.

(21) Appl. No.: 13/361,422

(22) Filed: Jan. 30, 2012

(65) Prior Publication Data

US 2012/0217141 A1 Aug. 30, 2012

(30) Foreign Application Priority Data

Feb. 25, 2011 (JP) ..... 2011-040178

(51) Int. Cl.
*H01H 9/28* (2006.01)

(52) U.S. Cl.
USPC ..... 200/43.13; 200/318.2

(58) Field of Classification Search
USPC ..... 200/43.13, 318.1, 318.2, 302.2, 334, 200/341, 566
See application file for complete search history.

(56) References Cited

U.S. PATENT DOCUMENTS

| | | | | |
|---|---|---|---|---|
| 5,180,050 | A * | 1/1993 | Rada et al. | 200/329 |
| 5,593,022 | A * | 1/1997 | Schaeffer et al. | 200/308 |
| 6,872,899 | B2 * | 3/2005 | Oshio et al. | 200/43.13 |
| 7,705,261 | B1 * | 4/2010 | Chen et al. | 200/566 |

FOREIGN PATENT DOCUMENTS

| | | | |
|---|---|---|---|
| JP | 8 212867 | A | 8/1996 |
| JP | 2010-104792 | A | 5/2010 |
| JP | H06 15230 | U | 5/2012 |

OTHER PUBLICATIONS

"Operating Instructions Recharegable Shaver Model No. ES-GA21", Panasonic Europe, dated Mar. 2, 2009, XP002676822.
European Search Report, EP12152982, dated May 30, 2012.

* cited by examiner

*Primary Examiner* — Kyung Lee
(74) *Attorney, Agent, or Firm* — Wolf, Greenfield & Sacks, P.C.; Randy J. Pritzker

(57) ABSTRACT

A switch is coupled to a switch support and includes a push button, a lock assembly, a tab, and a hook. The lock assembly includes an operation ring, which is rotated about the button between an unlock position to permit actuation of the button and a lock state to prohibit actuation of the button, and a lock ring, which is rotated integrally with the operation ring. When the operation ring is located at the lock position, the hook and the tab are arranged at the same position in a circumferential direction, which creates interference between the hook and the tab and blocks actuation of the button. When the operation ring is located at the unlock position, the hook and the tab are separated from each other in the circumferential direction, which avoids interference between the hook and the tab and permits actuation of the button.

9 Claims, 7 Drawing Sheets

SWITCH

CROSS-REFERENCE TO RELATED APPLICATIONS

This application is based upon and claims the benefit of priority from prior Japanese Patent Application No. 2011-040178, filed on Feb. 25, 2011, the entire contents of which are incorporated herein by reference.

BACKGROUND OF THE INVENTION

The present invention relates to a switch arranged on a portable electric device such as an electric shaver or a hair dryer.

Japanese Laid-Open Patent Publication No. 2010-104792 describes a prior art example of a switch for an electric shaver. The switch includes a push button and a lock assembly, which is shifted between an unlock state for permitting actuation of the button and a lock state for prohibiting actuation of the button. The lock assembly includes an operation ring and a lock ring. The operation ring is rotated about the button and moved between an unlock position, which corresponds to the unlock state, and a lock position, which corresponds to the lock state. The lock ring rotates integrally with the operation ring. The lock ring includes a rotational positioning portion. When the operation ring is located between the unlock position and lock position, the positioning portion is resiliently deformed by a fixed positioning portion, which is fixed to a case of an electric shaver. The resilient force produced when the rotational positioning portion is resiliently deformed guides the operation ring to the unlock position or lock position. The lock ring includes a hook. When the lock ring is located at the lock position, the hook comes into contact with the button and prohibits actuation of the button.

The rotational positioning portion and hook are formed integrally with the lock ring. This reduces the freedom for selection of the material of the lock ring. For example, there is a need to select a material that has resiliency suitable for the rotational positioning portion and rigidity suitable for the hook. When the freedom for material selection is small, it is difficult to form a lock assembly that provides satisfactory tactility and rigid lock strength.

The switch of the above '792 publication is assembled by holding the button between the lock ring and the operation ring. Thus, before the switch is coupled to a completed product such as an electric shaver, a test cannot be performed to determine whether the button can be pushed. For example, a test cannot be performed to determine whether the electric shaver functions normally when the button is pushed. The same applies when testing whether rotational force of the operation ring and lock ring can be transmitted when the button is held between the operation ring and lock ring. For example, a test cannot be performed to determine whether these components are properly coupled to each other and rotate integrally with each other. This may increase the operational defect rate of the switch in a completed product and lower the assembly efficiency.

SUMMARY OF THE INVENTION

One aspect of the present invention is a switch coupled to a switch support. The switch includes a push button, a lock assembly, at least one tab, and a hook. The lock assembly is shifted between an unlock state, which permits actuation of the button, and a lock state, which prohibits actuation of the button. The lock assembly includes an operation ring and a lock ring. The operation ring is rotated about the button between an unlock position, which corresponds to the unlock state, and a lock position, which corresponds to the lock state. The lock ring is coupled to and rotated integrally with the operation ring. The lock ring includes a rotational positioning portion that is resiliently deformed by a fixed positioning portion, which cannot be rotated relative to the switch support, when the operation ring is located at an intermediate position between the unlock position and the lock position to guide the operation ring to the unlock position or the lock position. The tab projects outward in a radial direction from the button. The hook is formed on the operation ring. When the operation ring is located at the lock position, the hook and the tab are arranged at the same position in a circumferential direction thereby blocking actuation of the button as the hook contacts the at least one tab. When the operation ring is located at the unlock position, the hook is separated from the at least one tab in the circumferential direction, which avoids interference between the tab and the hook and permits actuation of the button. Inner dimensions of the operation ring including the hook and inner dimensions of the lock assembly are the same as or greater than outer dimensions of the button excluding the tab.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

A switch according to one embodiment of the present invention will now be described with reference to FIGS. 1 to 8B.

Figure 1:
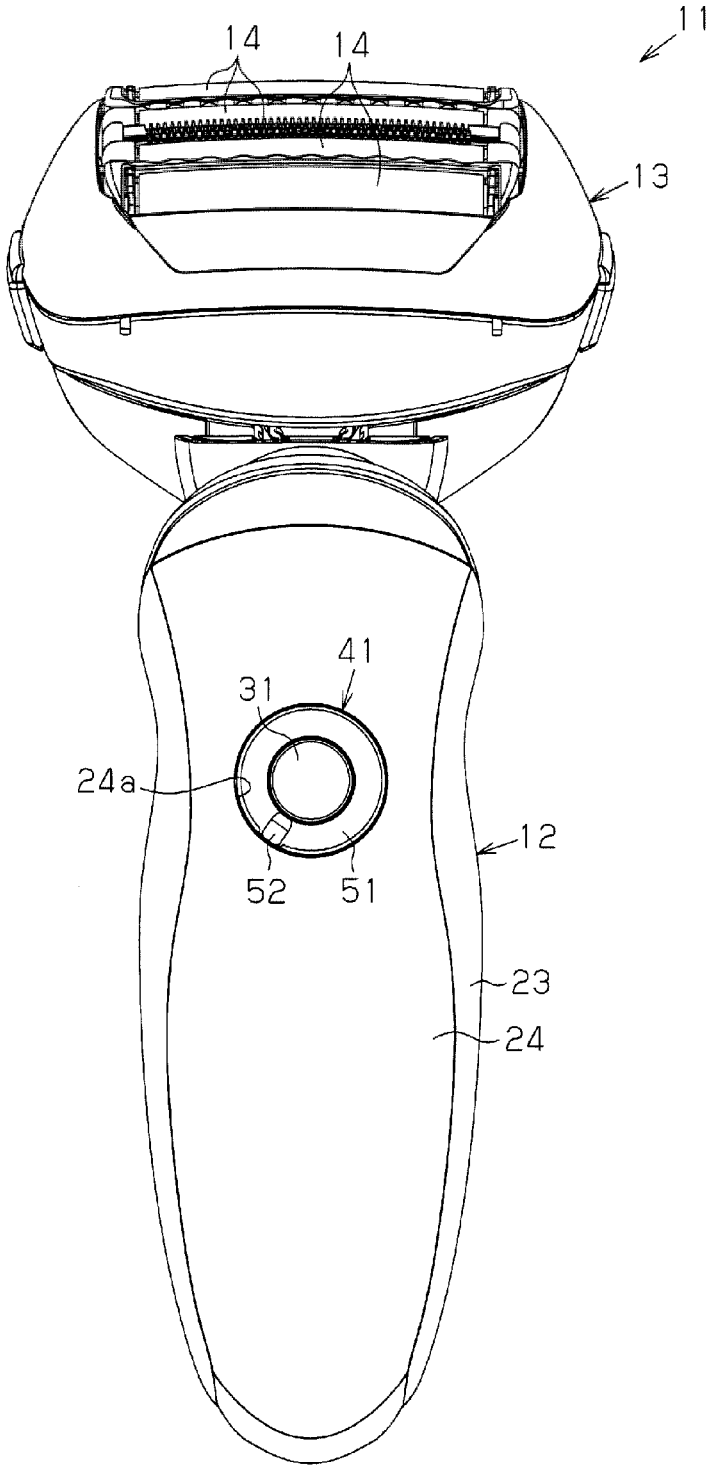
FIG. 1 is a front view showing an electric shaver according to one embodiment of the present invention.
Figure 2:
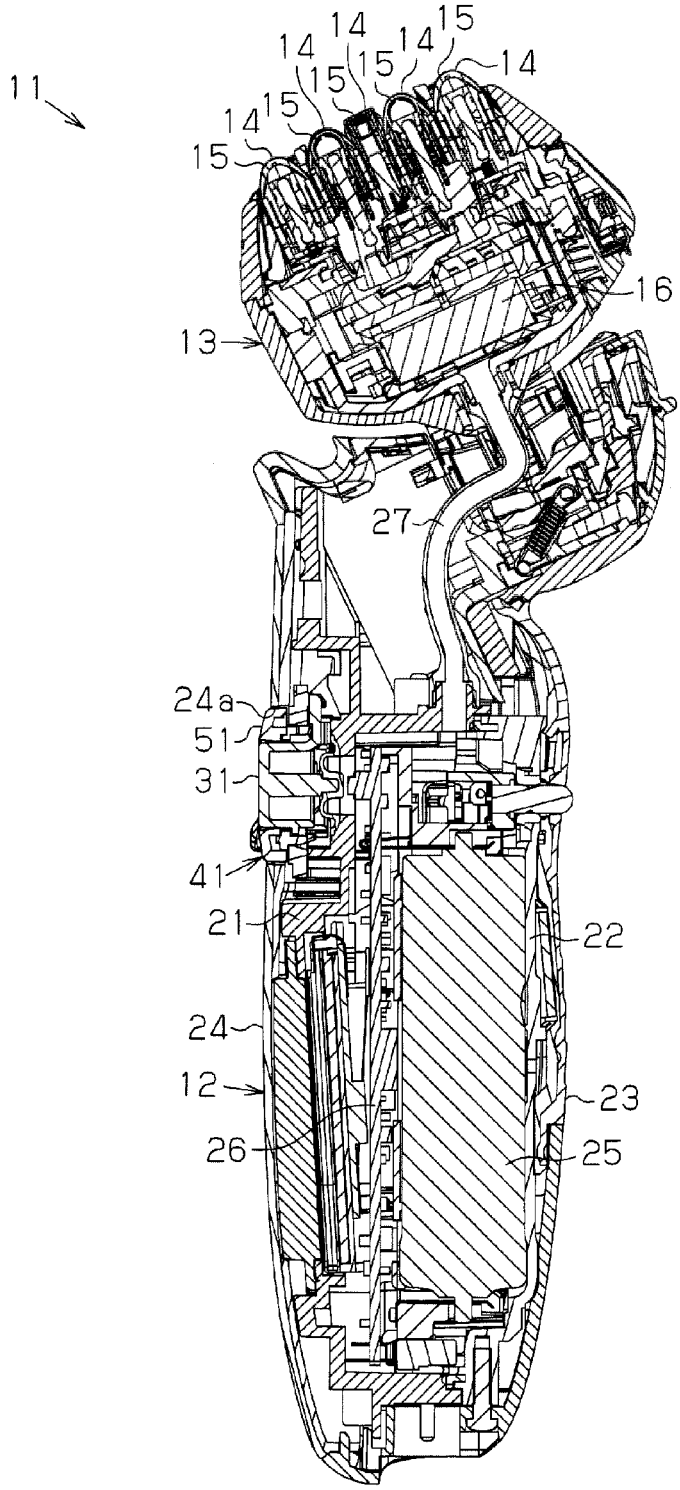
FIG. 2 is a cross-sectional diagram showing the electric shaver of FIG. 1.

As shown in FIGS. 1 and 2, the electric shaver 11 includes a grip 12 and a head 13. The grip 12 can be gripped by a user. The head 13 is arranged on top of the grip 12

A plurality (five in the present embodiment) of outer blades 14 are arranged next to one another in a top portion of the head 13. As shown in FIG. 2, a plurality of inner blades 15 are arranged inside the outer blades 14. The inner blades 15 are driven back and forth in the longitudinal directions of the outer blades 14 to shave body hair, which is guided into the outer blades 14. A linear motor 16, which is arranged in the head 13, drives the inner blades 15.

As shown in FIG. 2, the grip 12 includes first and second main body cases 21 and 22, a grip case 23, and a front panel 24. The first and second main body cases 21 and 22 accommodate electric components in a sealed state. The grip case 23 accommodates the first and second main body cases 21 and 22. The front panel 24 seals an opening formed in a front surface of the grip case 23. The first main body case 21 is one example of a switch support. The electric components include a rechargeable battery 25 and a circuit substrate 26 including circuit elements. The rechargeable battery 25 is electrically connected to the linear motor 16 via the circuit substrate 26 and a wire (not shown), which extends through a waterproof tube 27. A switch element 28 is arranged on the circuit substrate 26 (refer to FIG. 5). When the switch element 28 is pushed once, drive current is supplied from the rechargeable battery 25 to the linear motor 16. When the switch element 28 is pushed for a second time, the supply of drive current is stopped.

Figure 5:
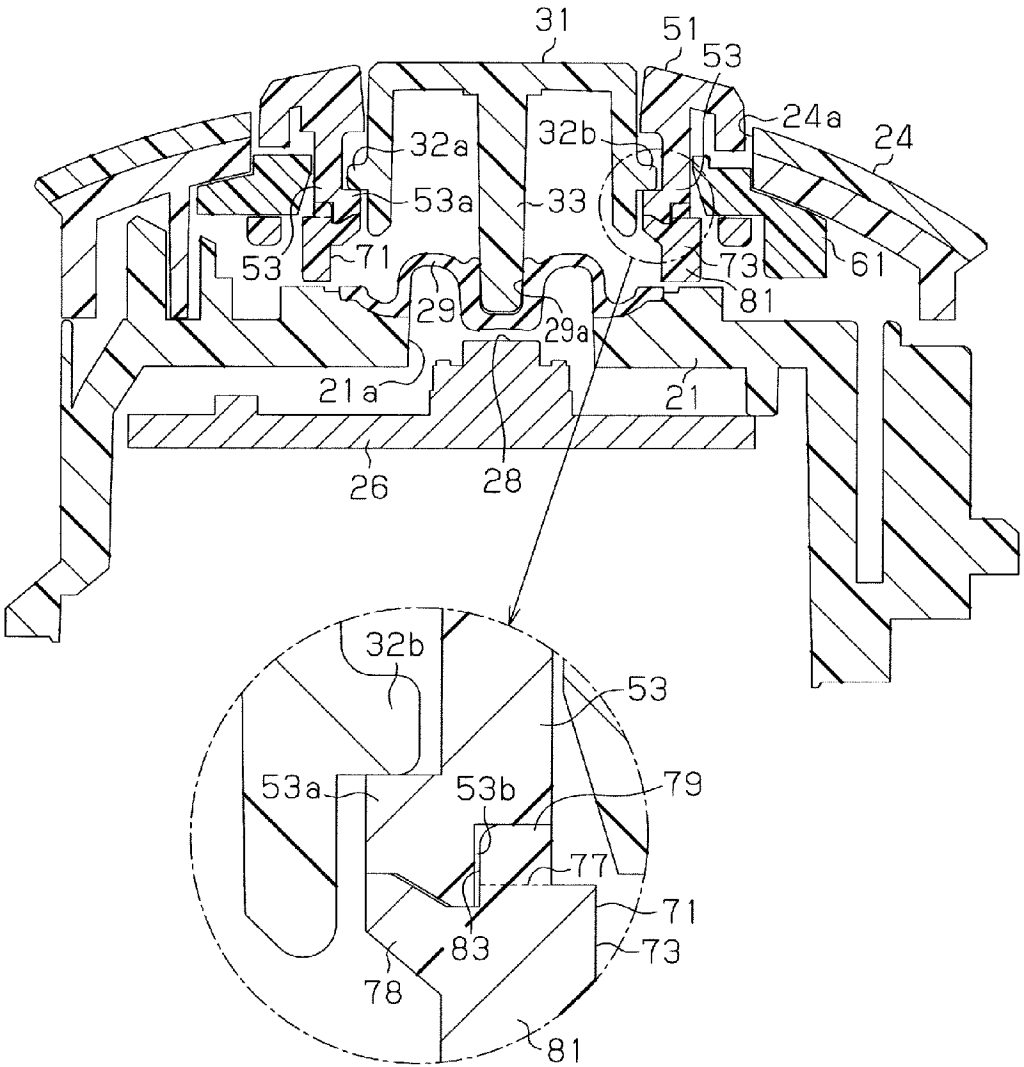
FIGS. 5 to 7 are cross-sectional views of the electric shaver shown in FIG. 1.

As shown in FIG. 5, the switch element 28 is aligned with an opening 21*a*, which extends through a front surface of the first main body case 21. A waterproof rubber member, or waterproof rubber cover 29, covers the opening 21*a*. The waterproof rubber cover 29 is resiliently deformable when the switch element 28 is pushed from the outer side and prevents liquid from entering the first main body case 21. Two-color molding, for example, is performed to form the waterproof rubber cover 29 on the first main body case 21.

Figure 3:
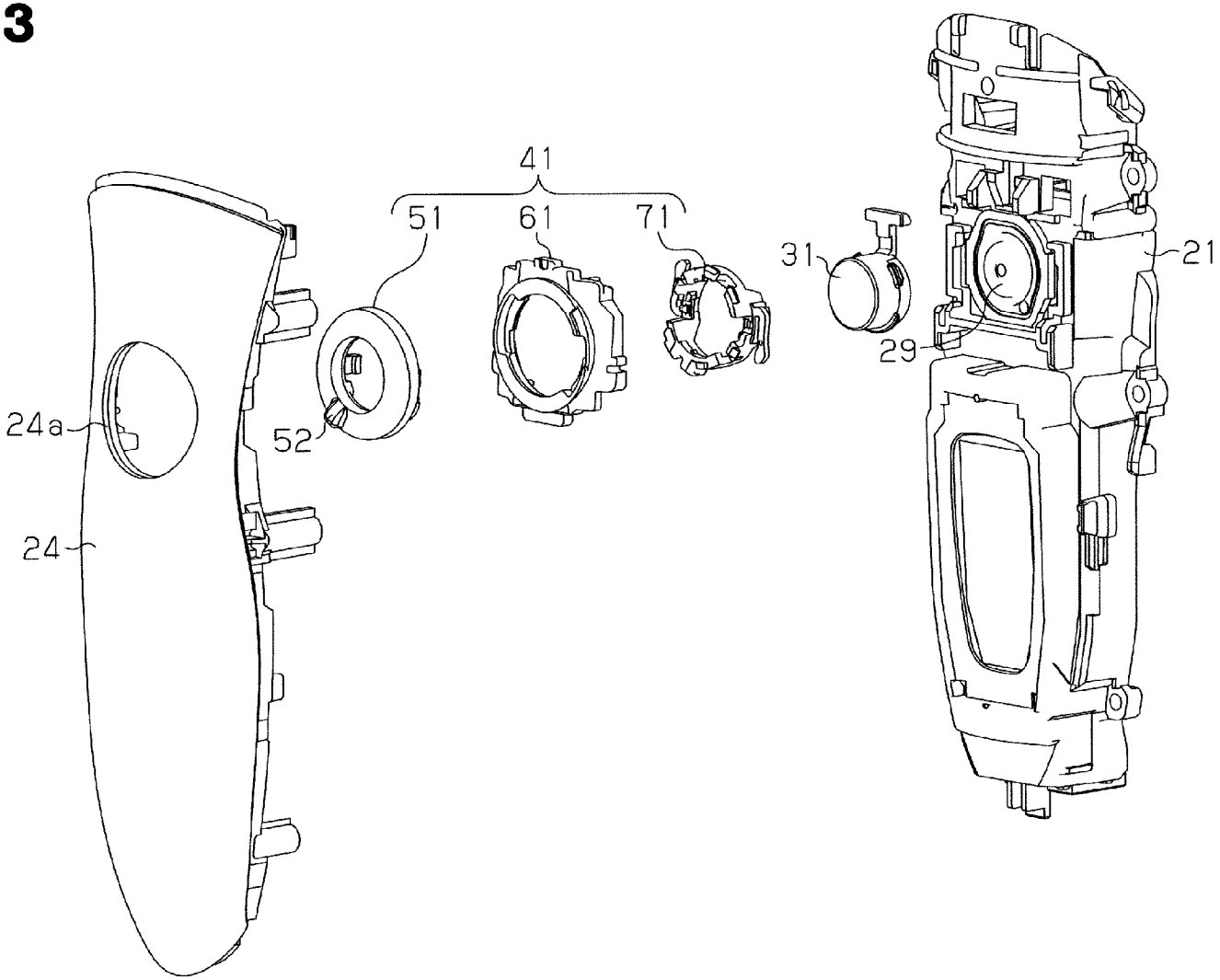
FIG. 3 is an exploded perspective view showing the electric shaver of FIG. 1.

As shown in FIG. 3, a panel opening 24*a* extends through the front panel 24 at a position corresponding to the waterproof rubber cover 29. In the illustrated example, the opening 24*a* is circular. A switch is arranged at a position corresponding to the waterproof rubber cover 29 and the panel opening 24*a*. The switch includes a push button 31 and a lock assembly 41, which is moved between an unlock position that permits the actuation of the button 31 and a lock position that prohibits actuation of the button 31. In the present embodiment, the actuation direction of the button 31, or the direction in which the button 31 is pushed, is also referred to as the axial direction of the lock assembly 41.

As shown in FIGS. 4A, 4B, 5, 8A, and 8B, the button 31 is generally cylindrical and includes an open end and a closed end, or a bottom. At least one tab, for example, three tabs 32*a* to 32*c* project outward in the radial direction from the outer circumferential surface of the button 31. In the present embodiment, the tabs 32*a* to 32*c* are spaced apart from one another in the circumferential direction.

As shown in FIG. 5, a transmission rod 33 extends from the inner side of the closed end of the button 31. The transmission rod 33 projects out of the open end of the button 31. The transmission rod 33 includes a distal portion fitted to a central recess 29*a*, which is formed in the waterproof rubber cover 29. When the button 31 is pushed and moves in the axial direction of the lock assembly 41, the transmission rod 33 and the waterproof rubber cover 29 push the switch element 28. The waterproof rubber cover 29 urges the button 31 in a direction opposite to the actuation direction when the button 31 and the lock assembly 41 are coupled to each other. The waterproof rubber cover 29 functions as an urging member.

As shown in FIGS. 4A, 4B, 8A, and 8B, a restriction piece 34 is formed between the two tabs 32*b* and 32*c* at the open end of the button 31. The restriction piece 34 extends farther outward in the radial direction than the tab 32*a*. The restriction piece 34 includes a distal portion arranged between two restriction portions 21*b* of the first main body case 21. Contact of the distal portion of the restriction piece 34 with the restriction portions 21*b* restricts rotation of the button 31 about the transmission rod 33.

Figure 4A:
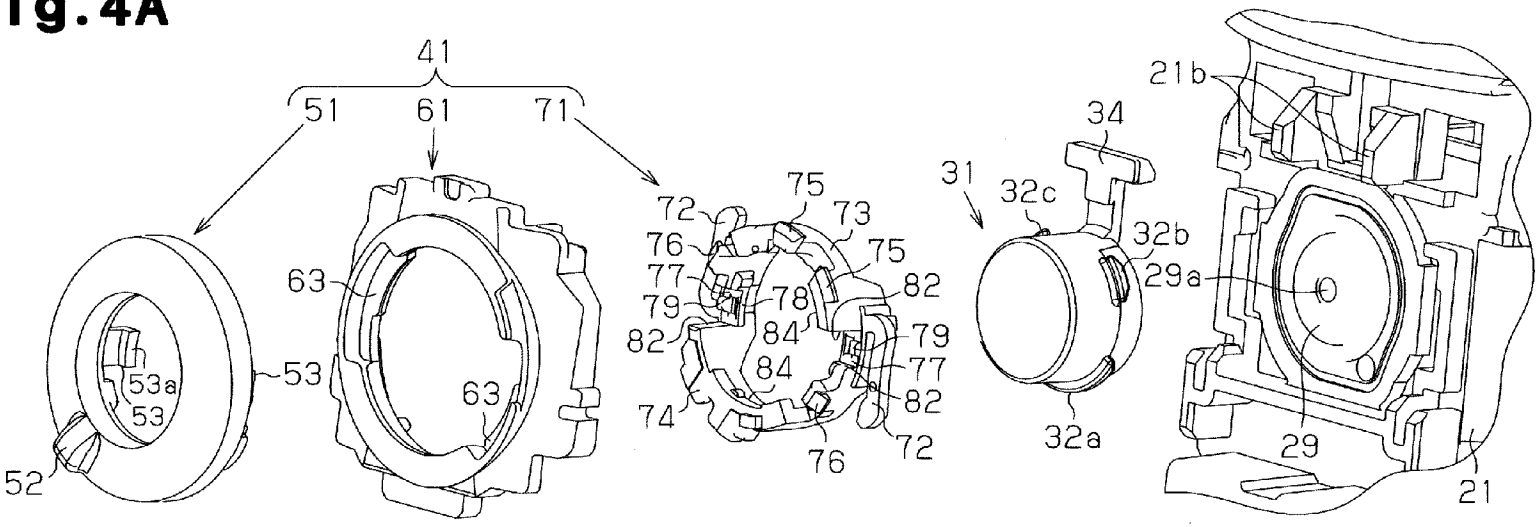
FIG. 4A is an enlarged exploded perspective view of FIG. 3.
Figure 4B:
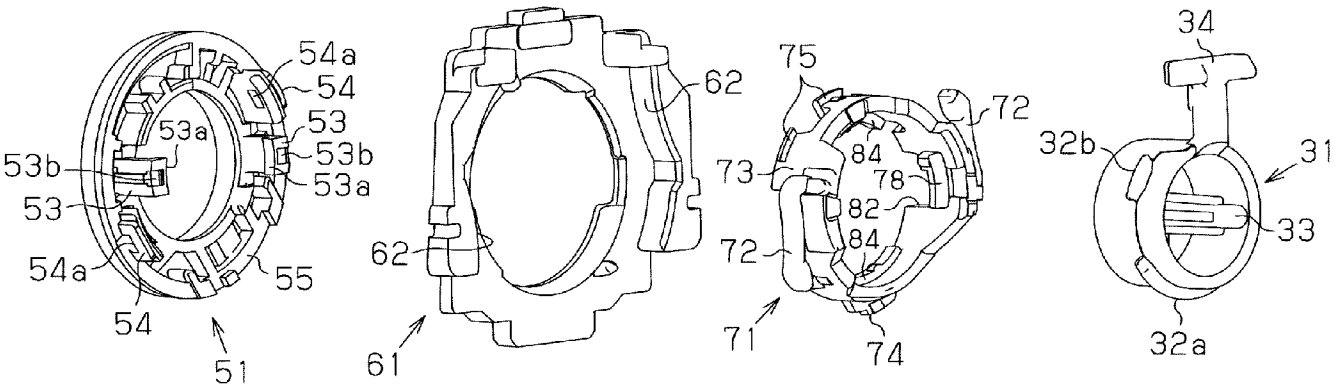
FIG. 4B is a rear perspective view showing some of the components of FIG. 4A.

As shown in FIGS. 4A and 4B, the lock assembly 41 of the present embodiment includes an operation ring 51, a lock base 61, and a lock ring 71.

The operation ring 51 includes a front surface, or annular operation surface, which is exposed from the panel opening 24*a* to the exterior of the front panel 24. The operation ring 51 is rotatable about the button 31 (transmission rod 33) and is movable between the unlock position and lock position. The lock assembly 41, or the switch, is in a lock state when at least the operation ring 51 is located at the lock position. The lock assembly 41, or the switch, is in an unlock state when at least the operation ring 51 is located at the unlock position.

The lock base 61 is held between the first main body case 21 and the front panel 24. This fixes the lock base 61 to the first main body case 21. The lock base 61 includes a fixed positioning portion 62.

The lock ring 71 is coupled to the operation ring 51 with the lock base 61 held between the lock ring 71 and the operation ring 51. The lock ring 71 rotates integrally with the operation ring 51. The lock ring 71 includes a rotational positioning portion 72.

The operation ring 51 will now be described in detail. As shown in FIGS. 1 and 3, an operation projection 52 is formed in part of the annular operation surface of the operation ring 51. The user can apply pressure with a finger to the operation projection 52 to easily rotate the operation ring 51.

Figure 8A:
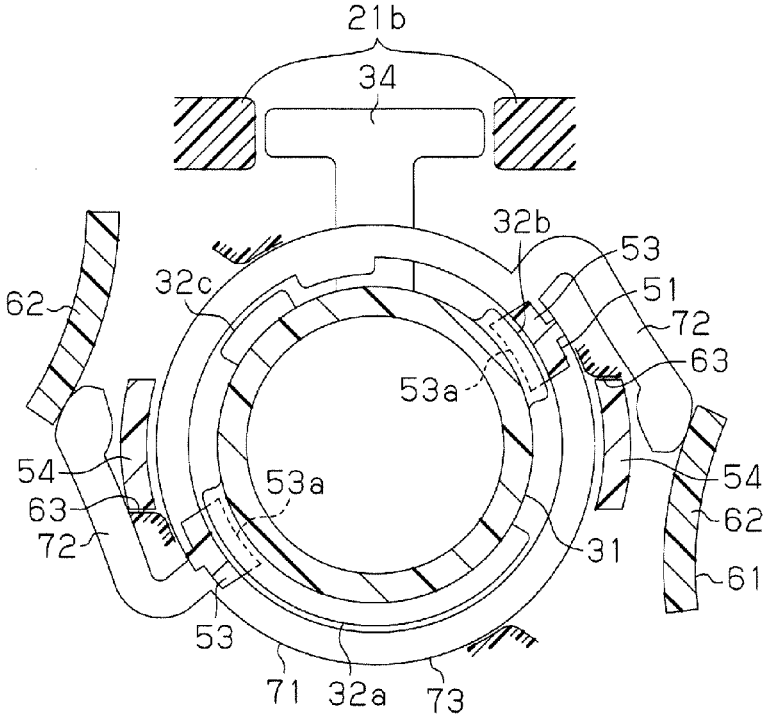
FIG. 8A is a schematic cross-sectional view showing a switch in a lock state.
Figure 8B:
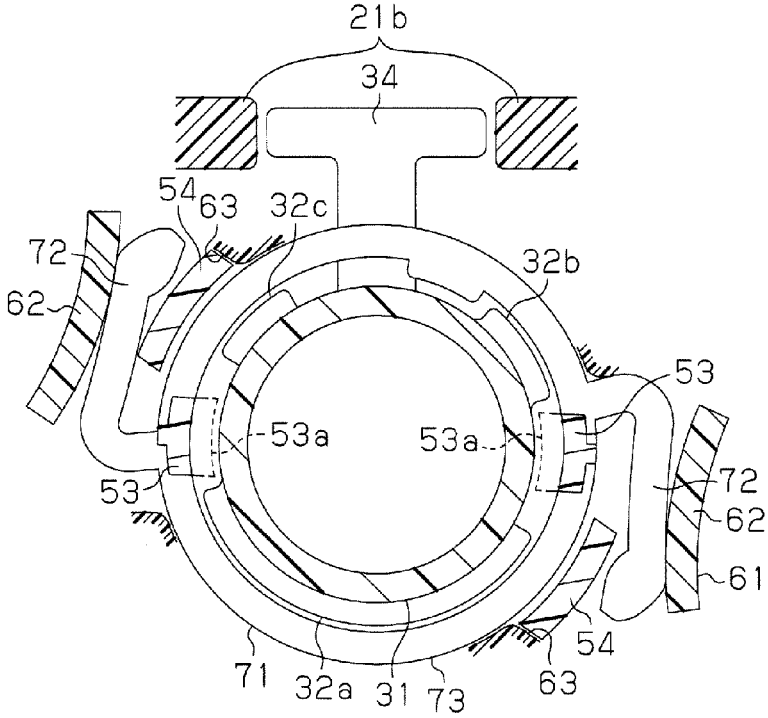
FIG. 8B is a schematic cross-sectional view showing the switch in an unlock state.

As shown in FIGS. 4B and 5, at least one hook, for example, two hooks 53 are formed on the rear surface of the operation ring 51. Each hook 53 includes a distal end from which an engagement portion 53*a* extends inward in the radial direction. In the present embodiment, the two hooks 53 are spaced apart from each other by 180 degrees in the circumferential direction. As shown in FIG. 8A, when the operation ring 51 is located at the lock position, the hooks 53 and the tabs 32*a* and 32*b* are arranged at the same positions in the circumferential direction. The hooks 53 (engagement portions 53*a*) contact the tabs 32*a* and 32*b* in the actuation direction. This prohibits actuation of the button 31. As shown in FIG. 8B, when the operation ring 51 is located at the unlock position, the hooks 53 are separated from the tabs 32*a* and 32*b* in the circumferential direction. The hooks 53 (engagement portions 53*a*) do not contact the tabs 32*a* and 32*b* in the actuation direction. This permits actuation of the button 31.

Figure 7:
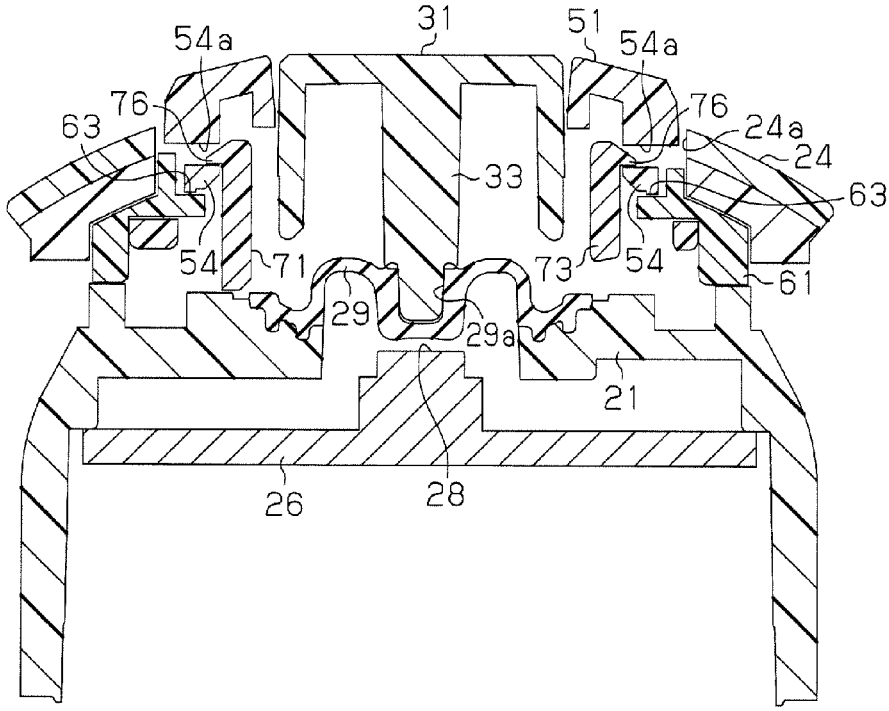

As shown in FIG. 4B and FIG. 5, a recess 53*b* is formed in the distal end of each hook 53. In the illustrated example, the recess 53*b* extends to the outer surface of the hook 53 in the radial direction. As shown in FIGS. 4B, 8A, and 8B, at least one projection, for example, two projections 54 project from the rear surface of the operation ring 51 at positions separated from the hooks 53. The projections 54 are located outward from the hooks 53 in the radial direction and separated from the hooks 53 in the circumferential direction. In the illustrated example, the two projections 54 are spaced part from each other by 180 degrees. As shown in FIGS. 4B and 7, a hooking hole 54*a* extends through each projection 54 in the radial direction.

As shown in FIG. 4B, a recess 55 is formed in the rear surface of the operation ring 51 at a position corresponding to the operation projection 52. As shown in FIGS. 4B and 5, the button 31 is fitted into the operation ring 51 so that the front surface of the button 31 is exposed from a central opening, or central window, of the operation ring 51. The inner dimensions of the operation ring 51, including the hooks 53, are generally the same or slightly greater than the outer dimensions of the button 31, excluding the tabs 32*a* to 32*c* and the restriction piece 34.

As shown in FIGS. 4A and 4B, the inner dimensions of the lock base 61 are greater than the inner dimensions of the central window of the operation ring 51 and generally the same as the inner dimensions at the projections 54 of the operation ring 51. In the illustrated embodiment, the projections 54 are not circular, and the inner dimension at each projection 54 refers to the distance from the center of the operation ring 51, that is, the transmission rod 33, to the inner end of the projection 54 in the radial direction. The inner dimensions of the other components are defined in the same manner.

As shown in FIG. 4A, arced recesses 63, which accommodate the projections 54 (refer to FIG. 4B), are formed in the front surface of the lock base 61. When the operation ring 51 is rotated, the projections 54 move along the arced recess 63. Each arced recess 63 includes two circumferential ends respectively corresponding to the lock position shown in FIG. 8A and the unlock position shown in FIG. 8B. The circumferential ends of the projections 54 contact the circumferential ends of the corresponding arced recesses 63. This restricts further rotation of the operation ring 51. Each arced recess 63 is formed to prohibit actuation of the button 31 when the corresponding projection 54 contacts one circumferential end of the arced recess (counterclockwise end as viewed in FIG. 8A) and the hooks 53 (engagement portions 53*a*) and the tabs 32*a* and 32*b* are arranged at the same positions in the circumferential direction. Further, each arced recess 63 is formed to permit actuation of the button 31 as the corresponding projection 54 contacts the other circumferential end of the arced recess (clockwise end as viewed in FIG. 8B) and the hooks 53 (engagement portions 53*a*) are separated from the tabs 32*a* and 32*b* in the circumferential direction.

As shown in FIGS. 4B and, 8A, and 8B, the fixed positioning portions 62 are formed on the rear surface of the lock base 61. Each fixed positioning portion 62 includes a convex curved surface bulged inward in the radial direction.

The lock ring 71 includes a tubular portion 73 fitted into the central hole of the lock base 61. The outer dimensions of the tubular portion 73 are generally the same or slightly smaller than the inner dimensions of the lock base 61.

As shown in FIG. 4A, the lock ring 71 is arranged rearward from the operation ring 51. An outer extension 74, which extends outward in the radial direction, is formed on the front end of the lock ring 71. The outer extension 74 corresponds to the recess 55 of the operation ring 51 (refer to FIG. 4B). The outer extension 74 is arranged between the bottom of the recess 55 and the front surface of the lock base 61.

As shown in FIG. 4A, at least one engagement hook, for example, two engagement hooks 75, project outward in the radial direction from the front end of the lock ring 71 (tubular portion 73) at positions spaced apart in the circumferential direction from the outer extension 74. The engagement hooks 75 are hooked to the front surface of the lock base 61. When the lock ring 71 is coupled to the lock base 61, the outer extension 74 is first arranged in front of the lock base 61 through the central hole of the lock base 61. Then, the engagement hooks 75 are hooked to the front surface of the lock base 61 and coupled to the lock base 61.

As shown in FIGS. 4A and 7, at least one coupling hook, for example, two coupling hooks 76 are formed on the front end of the lock ring 71 (tubular portion 73) projecting outward in the radial direction. In a state in which the lock ring 71 is coupled to the lock base 61, the coupling hooks 76 are arranged in the arced recesses 63. In this state, the projections 54 of the operation ring 51 are accommodated in the arced recesses 63, and the coupling hooks 76 are fitted to the hooking holes 54*a* of the projections 54 (refer to FIGS. 4B and 7) to couple to the lock ring 71 to the operation ring 51.

The rotational positioning portion 72 of the lock ring 71 will now be described with reference to FIGS. 4A, 4B, 8A, and 8B. The rotational positioning portion 72 includes two bent arms, which extend outward in the radial direction from the outer surface of the tubular portion 73 of the lock ring 71 and then further extend in the circumferential direction. The rotational positioning portion 72 (two arms) is resiliently deformed by the fixed positioning portion 62 when the operation ring 51 is located at an intermediate position between the unlock position and the lock position. The resilient force of the rotational positioning portion 72 guides the operation ring 51 and the lock ring 71 from the intermediate position to the unlock position or lock position. The rotational positioning portion 72 cooperates with the fixed positioning portion 62 to form a positioning structure that provides a tactile feedback sensation to a user.

As shown in FIG. 4A, grooves 77, which receive the hooks 53 (refer to FIG. 4B) of the operation ring 51, are formed in the front surface of the lock ring 71 (tubular portion 73). As shown in FIGS. 4A and 5, an inner extension 78 extends inward in the radial direction from the bottom of each groove 77. The inner extension 78 contacts the engagement portion 53*a* of the corresponding hook 53. A projection 79, which receives the recess 53*b* of the corresponding hook 53 (refer to FIGS. 4B and 5) is formed on the bottom of the groove 77.

As shown in FIG. 5, in the present embodiment, part of the tubular portion 73 of the lock ring 71 functions as a seat 81. The seat 81 is defined by the parts of the tubular portion 73 extending in the axial direction from the bottoms of the grooves 77. The seat 81 is held between the hooks 53 and the first main body case 21 in accordance with the force applied to the button 31 in the lock state.

As shown in FIG. 4A, one side surface in each groove 77 of the lock ring 71 functions as a circumferential contact surface 82. The circumferential contact surface 82 contacts the circumferential end of the corresponding hook 53.

As shown in FIG. 5, one side surface of each projection 79 in the lock ring 71 functions as an outer contact surface 83. The outer contact surface 83 contacts the radial outer surface of the recess 53*b* in the corresponding hook 53.

Figure 6:
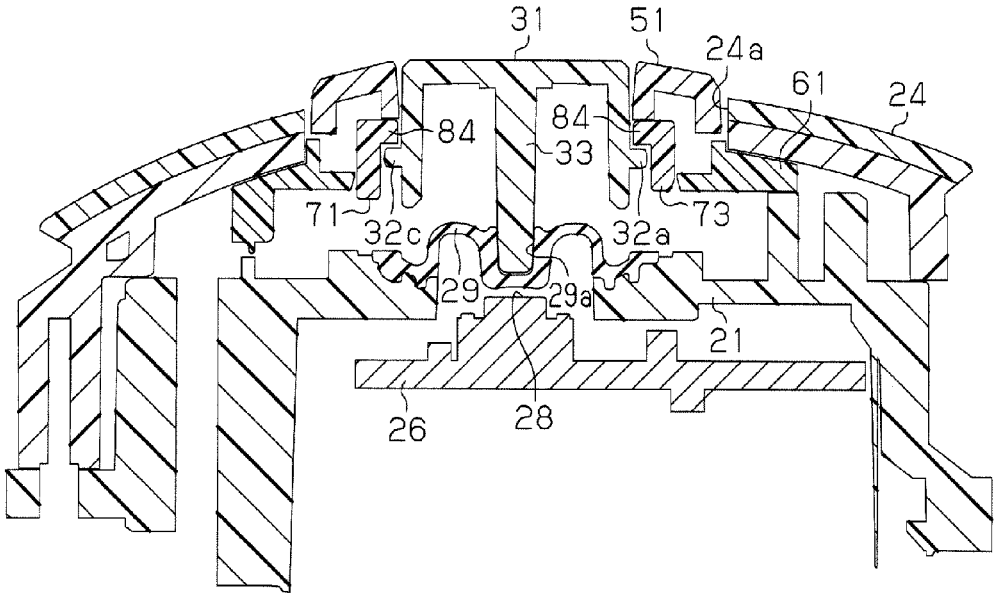

As shown in FIGS. 4A, 4B, and 6, a plurality of (two in the present embodiment) front seats 84 project inward in the radial direction from the front end of the lock ring 71 (tubular portion). The front seats 84 contact the front surfaces of the tabs 32*a* and 32*c* (surfaces that face a direction that is opposite to the actuation direction) of the button 31.

The inner dimensions of the lock ring 71 (tubular portion 73) is generally the same or slightly greater than the outer dimensions of the button 31, excluding the tabs 32*a* to 32*c* and the restriction piece 34. The button 31 is fitted into the lock ring 71 (tubular portion 73).

In the present embodiment, the button 31 can solely be coupled to the first main body case 21. More specifically, the button 31 is coupled to the main body case 21 before the button 31 and lock assembly 41 are coupled to each other by fitting the distal portion of the transmission rod 33 of the button 31 into the central recess 29*a* of the waterproof rubber cover 29 while arranging the distal portion of the restriction piece 34 of the button 31 between the restriction portions 21*b* of the main body case 21.

As described above, the lock ring 71 is coupled to the lock base 61, and the operation ring 51 is then coupled to the lock ring 71 sandwiching the lock base 61 to assemble the lock assembly 41. The lock assembly 41 is coupled to the first main body case from above the button 31 in correspondence with the unlock position. Then, the front panel 24 is coupled to the first main body case 21 from above the lock assembly 41 so as to hold the rim of the lock base 61.

The operation of the electric shaver 11 will now be described.

As shown in FIG. 8B, when the operation ring 51 is located at the unlock position, the tabs 32*a* and 32*b* are separated from the hooks 53 (engagement portions 53*a*) in the circumferential direction. Thus, when the user pushes the button 31, the transmission rod 33 pushes the switch element 28 by means of the waterproof rubber cover 29. As a result, the rechargeable battery 25 supplies drive current to the linear motor 16 and drives the inner blades 15 back and forth.

As shown in FIG. 8A, when the operation ring 51 is located at the lock position, the hooks 53 (engagement portions 53*a*) and the tabs 32*a* and 32*b* are arranged at the same position in the circumferential direction. Thus, when the user pushes the button 31, the tabs 32*a* and 32*b* of the button 31 come into contact with the engagement portions 53*a* of the hooks 53, and the button 31 cannot be pushed. As a result, for example, when the electric shaver 11 is carried in a bag with the switch in a locked state, the button is prevented from being pushed by an impact.

The above embodiment has the advantages described below.

(1) The hooks 53, which come into contact with the tabs 32*a* and 32*b* of the button 31 and prohibit actuation of the button 31, are arranged on the operation ring 51. The rotational positioning portion 72 is arranged on the lock ring 71. The hooks 53, which are preferably rigid, and the rotational positioning portion 72, which is preferably resiliently deformable, are arranged on different members, namely, the operation ring 51 and the lock ring 71. This increases the freedom for selection of material compared to when the hooks 53 and the rotational positioning portion 72 are arranged on the same lock ring 71. For example, the operation ring 51, which includes the hooks 53, can be formed from a highly rigid material. The lock ring 71, which includes the rotational positioning portion 72, can be formed from a resilient material having a relatively low resiliency so as to provide satisfactory tactility for the user. This provides a switch having satisfactory tactility and allowing for rigid locking.

The inner dimensions of the operation ring 51, which includes the hooks 53, and the inner dimensions of the lock ring 71, are the same or greater than the outer dimensions of the button 31. For example, after coupling the button 31 to the first main body case 21 like in the present embodiment, the operation ring 51 and the lock ring 71 can be coupled from above the button 31 in the actuation direction at a circumferential position corresponding to the unlock position. For example, in a state in which the button 31 is coupled to the first main body case 21 but the operation ring 51 and lock ring 71 are not coupled to the first main body case 21, the actuation of the button 31 can be tested. Alternatively, in a state in which the operation ring 51 and lock ring 71 are coupled to each other like in the present embodiment but the button 31 is not coupled to the operation ring 51 and lock ring 71, the transmission of rotational force in the operation ring 51 and lock ring 71 can be tested to determine whether they have been properly coupled. As a result, for example, in comparison with when assembling and manufacturing a completed product (electric shaver 11) without performing the above tests, the operational defect rate of the switch in completed products is decreased, and the assembly efficiency is increased.

(2) The lock ring 71 includes the seat 81 (refer to FIG. 5), which is held between the hooks 53 and the first main body case 21 in accordance with the pushing force of the button in a lock state. Thus, even when, for example, the user attempts to push the button 31 by applying a large force, the pushing force is received by the first main body case 21 through the seat 81. As a result, for example, excessive deformation of the hooks 53 can be avoided, and actuation of the button 31 can be prohibited, despite a large pushing force. This prevents damage to the hooks 53.

(3) The lock ring 71 includes the circumferential contact surfaces 82 (refer to FIGS. 4A and 4B), which come into contact with the circumferential ends of the corresponding hooks 53. As a result, the hooks 53 also function to transmit the rotational operation force of the operation ring 51 to the lock ring 71. Thus, less space is used. For example, when the button 31 is pushed in a direction diagonal to the normal pushing direction, even if the diagonal force is applied to the hooks 53, the circumferential contact surfaces 82 prevent the hooks 53 from being twisted and deformed.

(4) The lock ring 71 includes the outer contact surfaces 83 (refer to FIG. 5), which contact the radial outer surfaces of the recesses 53*b* in the corresponding hooks 53. Thus, the outer contact surfaces 83 prevent the hooks 53 from being forced outward in the radial direction and deformed. More specifically, when the button 31 is pushed with a large force, the hooks 53, which support the tabs 32*a* and 32*b* at an inward side in the radial direction, may receive a large force directed outward in the radial direction. Even in such a case, the hooks 53 are prevented from being forced outward in the radial direction and deformed.

(5) The waterproof rubber cover 29 urges the button 31 in a direction opposite to the actuation direction. The lock ring 71 includes the front seats 84 (FIGS. 4A, 4B, and 6), which contact the outwardly facing surfaces of the tabs 32*a* and 32*c*. As a result, the urging force of the waterproof rubber cover 29 is received through the button 31 by the front seats 84 of the lock ring 71. This prevents the button 31 and the operation ring 51 from contacting each other under pressure. As a result, for example, by forming the lock ring 71 with a low coefficient of friction, the friction between the operation ring 51 and the button 31 does not have to be taken into account. This increases the freedom for selection of the material for the operation ring 51 and the button 31, which are exposed to the exterior.

(6) The button 31 includes the restriction piece 34, which extends farther outward in the radial direction than the lock ring 71. The restriction piece 34 comes into contact with the restriction portions 21*b* of the first main body case 21. This restricts rotation of the button 31. Thus, there is no need for providing space in the lock ring 71 for the restriction portions 21*b*. This allows the lock ring 71 to be entirely reduced in size and thickness.

(7) The fixed positioning portion 62 is arranged on the lock base 61, which is fixed to the first main body case 21. The lock base 61 is held between the lock ring 71 and the operation ring 51. Thus, for example, in a state in which the operation ring 51, lock base 61, and the lock ring 71 are coupled together and the button 31 is not coupled, the movement of the positioning structure formed by the fixed positioning portion 62 and the rotational positioning portion 72 can be checked. As a result, for example, in comparison with when assembling and manufacturing a completed product (electric shaver 11) without performing the checking described above, the operational defect rate of the switch in completed products is decreased, and the assembly efficiency is increased.

(8) The lock ring 71 includes the outer extension 74, which is arranged and held between the rear surface of the operation ring 51, at a position corresponding to the operation projection 52 of the operation ring 51 (more specifically, the bottom of the recess 55), and the front surface of the lock base 61. Thus, for example, when the user rotates the operation ring 51 while pushing the operation projection 52 of the operation ring 51, the outer extension 74 prevents the operation ring 51 from directly coming into contact with the lock base 61 under pressure. As a result, for example, by forming the lock ring 71 with a low frictional coefficient, friction between the operation ring 51 and the lock base 61 does not have to be taken into account. This increases the freedom for selection of the material for the operation ring 51 and the lock base 61, which are exposed to the exterior.

It should be apparent to those skilled in the art that the present invention may be embodied in many other specific forms without departing from the spirit or scope of the invention. Particularly, it should be understood that the present invention may be embodied in the following forms.

In the above embodiment, the seat 81 of the lock ring 71 is held between the hooks 53 and the first main body case 21 in accordance with the pushing force of the button 31 in a lock state. However, the present invention is not limited in such a manner, and the seat 81 may be eliminated.

In the above embodiment, the lock ring 71 includes the circumferential contact surfaces 82, which contact the circumferential ends of the corresponding hooks 53. However, the present invention is not limited in such a manner, and the circumferential contact surfaces 82 may be eliminated.

In the above embodiment, the lock ring 71 includes the outer contact surfaces 83, which contact the radial outer surface of the recesses 53*b* in the corresponding hooks 53. However, the present invention is not limited in such a manner, and the outer contact surfaces 83 may be eliminated.

In the above embodiment, the button 31 is urged by the waterproof rubber cover 29 in a direction opposite to the actuation direction. However, the present invention is not limited in such a manner, and the button 31 may be urged by an urging member other than the waterproof rubber cover 29.

In the above embodiment, the front seats 84 of the lock ring 71 come into contact with the tabs 32*a* and 32*c* when the button 31 moves in a direction opposite to the actuation direction. However, the present invention is not limited in such a manner, and the front seats 84 of the lock ring 71 may be eliminated.

In the above embodiment, the restriction piece 34 of the button 31 projects outward in the radial direction from the lock ring 71. However, the present invention is not limited in such a manner, and the restriction piece 34 may be arranged inward from the rim of the lock ring 71.

In the above embodiment, the lock base 61 includes the fixed positioning portion 62. However, the present invention is not limited in such a manner. The fixed positioning portion is only required to be fixed to the first main body case 21 so that it does not rotate and may be formed integrally with, for example, the first main body case 21. In this case, the lock base 61 can be eliminated.

In the above embodiment, the outer extension 74 of the lock ring 71 does not have to be held between the rear surface of the operation ring 51, at a position corresponding to the operation projection 52 of the operation ring 51, and the front surface of the lock base 61. For example, the outer extension 74 does not have to be arranged at a position corresponding to the operation projection 52 of the operation ring 51.

The switch is arranged on the electric shaver 11. However, the switch according to the present invention may be arranged on other electric devices such as a hair dryer or an electric toothbrush.

The present examples and embodiments are to be considered as illustrative and not restrictive, and the invention is not to be limited to the details given herein, but may be modified within the scope and equivalence of the appended claims.

The invention claimed is:

1. A switch coupled to a switch support, the switch comprising:

a push button;

a lock assembly that is shifted between an unlock state, which permits actuation of the button, and a lock state, which prohibits actuation of the button, wherein the lock assembly includes an operation ring rotated about the button between an unlock position, which corresponds to the unlock state, and a lock position, which corresponds to the lock state, a lock ring coupled to and rotated integrally with the operation ring, wherein the lock ring includes a rotational positioning portion that is resiliently deformed by a fixed positioning portion, which cannot be rotated relative to the switch support, when the operation ring is located at an intermediate position between the unlock position and the lock position to guide the operation ring to the unlock position or the lock position;

a tab projecting outward in a radial direction from the button; and a hook formed on the operation ring, wherein when the operation ring is located at the lock position, the hook and the tab are arranged at the same position in a circumferential direction thereby blocking actuation of the button as the hook contacts the tab, when the operation ring is located at the unlock position, the hook is separated from the tab in the circumferential direction, which avoids interference between the tab and the hook and permits actuation of the button, and inner dimensions of the operation ring including the hook and inner dimensions of the lock assembly are the same as or greater than outer dimensions of the button excluding the tab.

2. The switch according to claim 1, wherein the lock ring includes a seat held between the hook and the switch support in accordance with a pushing force applied to the button in the lock state.

3. The switch according to claim 1, wherein the lock ring includes a circumferential contact surface that contacts a circumferential end of the hook.

4. The switch according to claim 1, wherein the lock ring includes an outer contact surface that contacts an outer surface of the hook in a radial direction.

5. The switch according to claim 1, wherein the button is urged in a direction opposite to a pushing direction by an urging member, which is fixed to the switch support, and the lock ring includes a front seat that contacts the tab of the button in the urging direction.

6. The switch according to claim 1, wherein the switch support includes a restriction portion that prohibits movement of the switch support, the button includes a restriction piece that extends farther outward in the radial direction than the lock ring, and the restriction piece contacts the restriction portion thereby restricting rotation of the button.

7. The switch according to claim 1, wherein the lock assembly further includes a lock base fixed to the switch support, the lock base is held between the lock ring and the operation ring, and the fixed positioning portion is arranged on the lock base.

8. The switch according to claim 1, wherein the button includes a front surface, which is exposed from a central window of the operation ring, an open end, which is opposite to the front surface, and a restriction piece, which projects outward in a radial direction from the open end, and the restriction piece extends across the lock ring in the radial direction rearward from a rear surface of the lock ring, which is arranged rearward from the operation ring.

9. The switch according to claim 1, wherein the operation ring including the hook and the lock ring including the rotational positioning portion are mutually different members.

* * * * *